United States Patent [19]

Watts et al.

[11] Patent Number: 4,594,739

[45] Date of Patent: Jun. 17, 1986

[54] PROTECTIVE DRAIN

[76] Inventors: Brian R. Watts, 18512 S. Bainbrook, Cerritos, Calif. 90701; Robert E. Carlton, 1019 Ocean Ave., "C", Seal Beach, Calif. 90740

[21] Appl. No.: 612,246

[22] Filed: May 21, 1984

[51] Int. Cl.[4] ..... A47K 1/14; E03C 1/26

[52] U.S. Cl. ..... 4/287; 4/288; 4/292; 4/295; 137/844

[58] Field of Search ..... 4/286–295; 137/844, 845; 114/73, 197

[56] References Cited

U.S. PATENT DOCUMENTS

| | | | |
|---|---|---|---|
| Re. 31,561 | 8/1984 | Thompson | 4/292 X |
| 225,776 | 3/1880 | Wilson | 137/844 |
| 2,629,393 | 2/1953 | Langdon | 137/844 X |
| 2,793,371 | 5/1957 | Vesconte | 137/844 X |
| 2,822,819 | 2/1958 | Geeraert | 137/844 |
| 2,859,452 | 11/1958 | Seewack | 4/288 |
| 2,922,437 | 1/1960 | Rippingille | 137/844 |
| 3,420,552 | 1/1969 | Mork | 4/288 X |
| 3,491,791 | 1/1970 | Polk | 137/844 |
| 3,903,942 | 9/1975 | Vest | 137/844 X |

FOREIGN PATENT DOCUMENTS

| | | | |
|---|---|---|---|
| 2114711 | 8/1983 | United Kingdom | 137/844 |

*Primary Examiner*—Henry K. Artis

*Attorney, Agent, or Firm*—Sheldon & Mak

[57] ABSTRACT

A floor drain for hazardous environments comprises a grating, a housing, and an elastic one-way valve clamped by a flange between the grating and the housing. The valve has a tubular body with contacting parallel wall portions which open when a liquid enters the valve. The valve closes when there is no pressure at the inlet. The valve closes more tightly in the event of elevated down stream pressure, positively preventing the escape of gas. An existing, unprotected drain can be retrofitted with the one-way valve.

5 Claims, 4 Drawing Figures

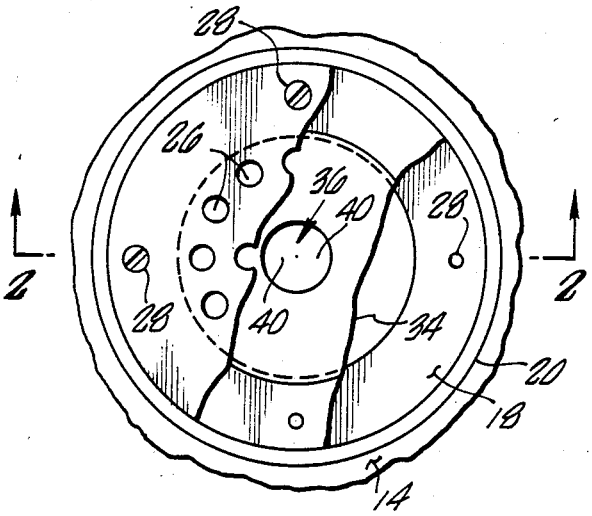
FIG. 1.
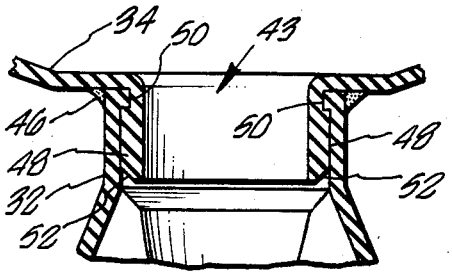
FIG. 4.
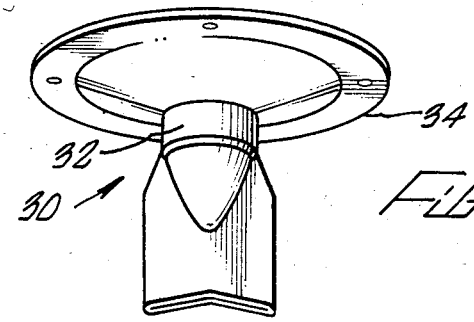
FIG. 3.
FIG. 2.
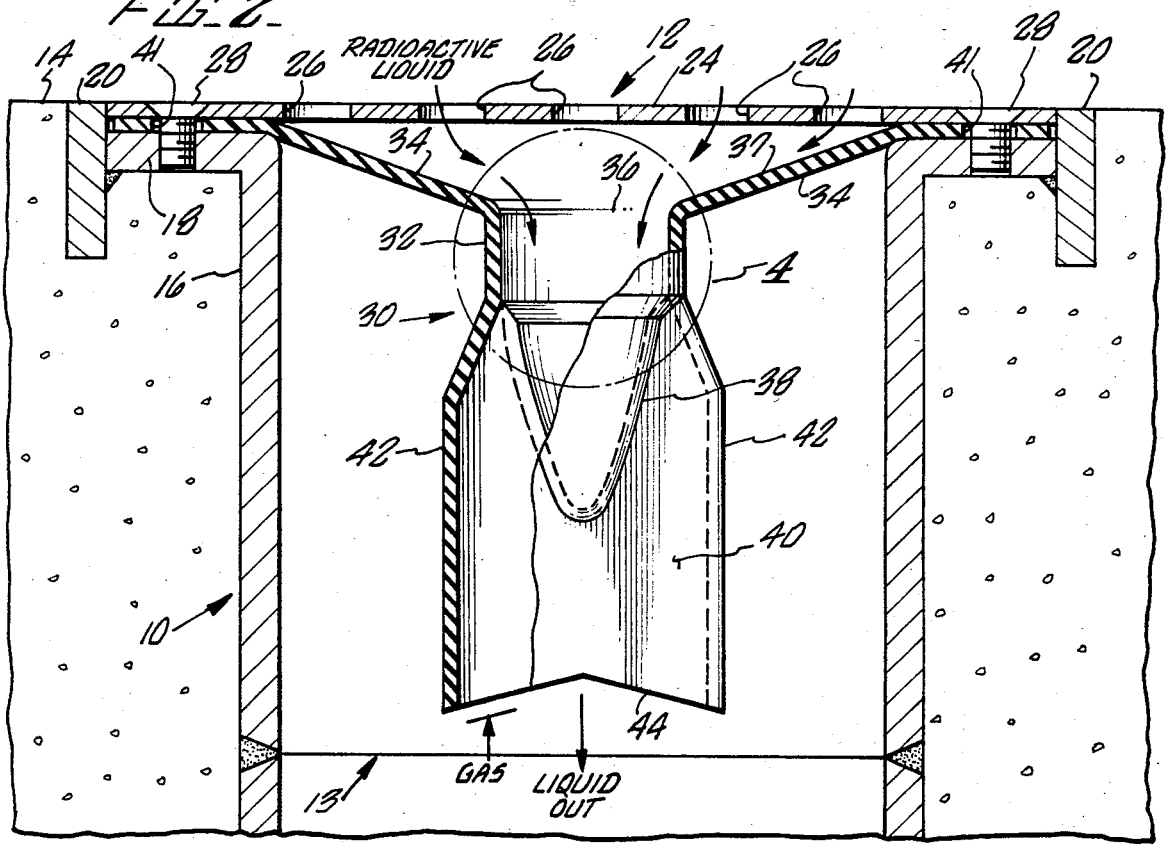

PROTECTIVE DRAIN

BACKGROUND

This invention relates to the drainage system art and more particularly to the drainage of enclosed areas in nuclear power plants.

A common drainage system includes a trap for each drain formed to retain enough liquid to prevent the upstream escape of downstream gases. Exemplary drain traps are the traps found below bathroom sinks. One disadvantage of this system is that a large gas pressure differential across the trap can cause the trap to "blow" its liquid and become ineffective.

An alternative to traps is the use of ball check-valves in place of the traps so that a high pressure downstream does not cause gas to escape. A disadvantage of the traps and check-valves of the prior art is that these valves accumulate solids and are easily clogged. Contamination of the valves with hazardous waste is especially undesirable in nuclear power plants due to the danger of high concentrations of radioactive contaminants. Therefore, an accumulation not amounting to blockage is a serious hazard in a nuclear environment.

In an effort to avoid the above disadvantages, other systems have been built without traps or valves but with means to ventilate drain gases and/or to provide a positive pressure differential between the enclosure and the drain system. These approaches have proven unreliable in practice.

There is a need, therefore, for a drain that can withstand relatively high pressure transients, does not accumulate large concentrations of hazardous radioactive contaminants, permits low-cost modification of existing systems not having traps or check-valves, and permits early detection and convenient removal of any waste accumulation in the drain.

SUMMARY

The drain of the present invention meets these needs by providing a flexible one-way valve within a drain housing to permit fluid to pass into the drainage system, but not from the system into the enclosure.

The drain comprises a floor drain housing and a one-way valve fastened to the housing. Fluid entering the housing is directed through the valve, which has a tubular body and oppositely disposed parallel flexible walls at an exit, the walls being held in contact to close the valve unless pressure on the extension of the walls is less than the pressure within the body, the valve permitting flow only from a housing inlet to an outlet. High pressure transients at the outlet compress the walls into tighter contact, preventing objectionable escape of gas and/or liquid from the drain.

The parallel flexible wall configuration of the one-way valve avoids clogging by further opening the exit under increased liquid pressure, releasing solids collected between the walls.

Preferably the valve is sealingly clamped to the housing at a flange extending radially from the body, the flange preferably being elastic and integral with the valve.

The valve, with the flange, can be adapted to retrofit existing drains. In addition, should an installed valve require replacement, it can easily be replaced at low cost.

Thus a drain is provided that can withstand pressure transients, that does not accumulate large concentrations of hazardous contamination, that permits low cost modification of existing systems and that permits convenient servicing.

DRAWINGS

These and other features, aspects, and advantages of the present invention will become better understood with reference to the following description, appended claims, and accompanying drawings where:

FIG. 1 is a fragmentary sectional plan view of one version of the drain of the present invention, the drain including a one-way valve having a flange;

FIG. 2 is a fragmentary sectional elevation of the drain taken along line 2—2 in FIG. 1;

FIG. 3 is an isometric view of the one-way valve and flange shown in FIGS. 1 and 2; and FIG. 4 is an enlarged detail sectional view of region 4 in FIG. 2 showing another version of the one-way valve with an attached flange. de

DESCRIPTION

With reference to FIGS. 1 and 2, a housing 10 having an inlet 12 and an outlet 13 is imbedded in a floor 14. The housing 10 is fabricated from a flared type nipple 16 having a flare 18. The housing 10 is welded at the flare 18 to the inside of a ring 20, the ring 20 being flush with the floor 14. The outlet 13 of the housing 10 is welded to and forms a part of a drainage system 22.

A grating 24 having a plurality of openings 26 is fastened to the housing 10 by a plurality of screws 28. A molded, tubular one-way valve 30 having a body 32 and a flange 34 is sealingly clamped between the grating 24 and the flare 18. The flange 34 has a plurality of clearance holes 41 for the screws 28. A valve entrance 36 is formed at the intersection of the body 32 with the flange 34, the flange 34 having a concave upper surface 37 for directing liquid into the valve entrance 36. The bottom of the body 32 has a tapered section 38 joining a pair of parallel wall members 40, the parallel wall members 40 being sealingly joined at a pair of edges 42. The one-way valve 30 is formed of a flexible elastic material such as rubber to permit the parallel wall members 40 to separate for opening an exit 44 when the inside pressure slightly exceeds the outside pressure of the valve.

Preferably, the parallel wall members 40 lie in sealing contact when there is no pressure differential across the valve, with exterior pressure forcing the parallel wall members 40 tighter into sealing contact.

In the preferred embodiment, the flange 34 and the one-way valve 30 comprise a single molded unit, the flange 34 being molded flat for ease of manufacture. The flange 34 sags, becoming concave, when suspending the one-way valve 30.

With reference to FIG. 4, another version of the one-way valve 30 may be fabricated from a commercial boat drain disclosed in U.S. Pat. No. 3,049,088 to Curtis. A body 32 of a commercial boat drain having an inlet 43 is joined to a flange 34 by a sealing adhesive 46. In this version, the flange 34 can be a flexible disk having a cylindrical protrusion 48 engaging a lip 50 in the inlet 43, the lip 50 securing the flange 34 to the body 32 while the sealing adhesive 46 cures, the cylindrical protrusion 48 and the lip 50 reinforcing the adhesive thereafter. A chamfer 52 on the cylindrical protrusion facilitates assembly of the flange 34 to the body 32.

In operation, any liquid passing through the grating 24 is collected at the valve entrance 36. Under the influence of gravity, the liquid passes into the body 32 whereupon the weight of the liquid produces a pressure between the parallel wall sections 40. The parallel wall sections 40 then separate forming the exit 44 for passing the liquid to the outlet 13. If either liquid or gas pressure at the outlet increases to equal or exceed the pressure at the inlet 12, the exit 44 closes to prevent the flow of either liquid or gas from the outlet to the inlet.

The configuration of the parallel wall sections 40 advantageously tends to prevent clogging of the one-way valve 30. Solids collected between the parallel wall sections 40 blocking liquid flow are released when additional pressure of the liquid further separates the parallel wall sections 40.

In the unlikely event that the drain does become clogged, the one-way valve 30 is easily accessible for replacement by removal of the grating 24. The one-way valve 30 can be made sufficiently inexpensive to be expendable so that the drain can be cleaned by replacing the one-way valve 30.

Preferably, the flange 34 is designed to fit between the grating 24 and the housing 10 of previously installed drains for protection of existing drainage systems by retrofitting the valve 30.

Although the present invention has been described in considerable detail with reference to certain preferred versions thereof, other versions are possible. For example, the flange 34 can be sized to fit between the screws 28, eliminating the holes 41. Therefore the spirit and scope of the appended claims should not necessarily be limited to the description of the prefered versions contained herein.

What is claimed is:

1. A liquid floor drain comprising:

(a) a housing having an inlet and an outlet;

(b) a one-way valve for permitting flow only from the inlet to the outlet, the valve comprising:

(i) a tubular body having an entrance and an exit, the body having oppositely disposed parallel flexible wall portions positioned to be held in contact for closing the exit under the influence of pressure on the exterior of the wall portions when such pressure is not less than the pressure within the body; and (ii) a flange extending radially outwardly from the entrance of the body for suspending the body within the housing; and (c) means for sealingly clamping the flange to the housing, wherein the top surface of the flange is concave for directing any liquid entering the inlet to the entrance.

2. A floor drain as defined in claim 1, in which the flange is elastic and integral with the body.

3. A one-way valve for protecting a floor drain having an inlet grating fastened to a housing having an outlet, the valve protecting the drain by permitting flow only from the inlet grating to the outlet, the one-way valve comprising:

(a) a tubular body having an entrance and an exit, the body having oppositely disposed parallel flexible wall portions positioned to be held in contact for closing the exit under the influence of pressure on the exterior of the wall portions when such pressure is not less than the pressure within the body; and (b) a flange extending radially outwardly from the entrance of the body for sealingly clamping the one-way valve between the inlet grating and the housing, wherein, when the body is supported by the flange with the exit positioned under the entrance, the top surface of the flange is concave for directing any fluid passing through the inlet grating to the entrance.

4. A method for preventing backflow in a drain having an inlet grating fastened to a housing having an outlet, the method comprising the steps of:

(a) removing the outlet grating;

(b) providing a one-way valve comprising:

(i) a tubular body having an entrance and an exit, the body having oppositely disposed parallel flexible wall portions positioned to be held in contact for closing the exit under the influence of pressure on the exterior of the wall portions when such pressure is not less than the pressure within the body; and (ii) a flange extending radially from the entrance of the body and axially away from the flexible wall portions;

(c) inserting the one-way valve into the housing with the body suspended from the flange; and (d) sealingly clamping the flange to the housing by the inlet grating for directing fluid entering the housing to the body and permitting flow only from the inlet grating to the outlet.

5. A method for cleaning a drain having a first one-way valve clamped between an inlet grating and a housing, the drain having objectionable matter in the first one-way valve, the method comprising the steps of:

(a) removing the inlet grating;

(b) removing the objectionable matter by removing and discarding the first one-way valve;

(c) providing a second one-way valve comprising:

(i) a tubular body having an entrance and an exit, the body having oppositely disposed parallel flexible wall portions positioned to be held in contact for closing the exit under the influence of pressure on the exterior of the wall portions when such pressure is not less than the pressure within the body; and (ii) a flange extending radially from the entrance of the body and axially away from the flexible wall portions;

(d) inserting the second one-way valve into the housing with the body suspended from the flange; and (e) sealingly clamping the flange between the housing and the inlet grating for directing fluid entering the housing to the body and permitting flow only from the inlet grating to the outlet.

* * * * *